US005469406A

United States Patent [19]

Scarpitta et al.

[11] Patent Number: 5,469,406

[45] Date of Patent: Nov. 21, 1995

[54] METHOD OF EMITTING VERY LOW FREQUENCY HIGH POWER ACOUSTIC WAVES, AND CORRESPONDING TRANSDUCERS THEREFOR

[75] Inventors: Alain A. Scarpitta, Toulon; Didier Boucher; Gilles Grosso, both of Six Fours, all of France

[73] Assignee: L'Etat Francais represente par le Deleque General pour l'Armement, Paris, France

[21] Appl. No.: 352,125

[22] Filed: Dec. 1, 1994

[30] Foreign Application Priority Data

Dec. 3, 1993 [FR] France ..... 93 14503

[51] Int. Cl.[6] ..... H04R 23/00

[52] U.S. Cl. ..... 367/171; 367/176

[58] Field of Search ..... 367/142, 171, 367/141, 172, 176

[56] References Cited

U.S. PATENT DOCUMENTS

| | | | |
|---|---|---|---|
| 4,135,142 | 1/1979 | Percy et al. | 367/171 |
| 4,524,693 | 6/1985 | McMahon et al. | 367/172 |
| 4,853,905 | 8/1989 | Myers | 367/172 |
| 5,223,570 | 8/1993 | Donskoy | 367/142 |
| 5,224,074 | 6/1993 | Sullivan | 367/176 |
| 5,268,879 | 12/1993 | Flanagan | 367/141 |

FOREIGN PATENT DOCUMENTS

| | | |
|---|---|---|
| 2634292 | 7/1988 | France . |
| 2665814 | 8/1990 | France . |
| 2671927 | 1/1991 | France . |

*Primary Examiner*—Charles T. Jordan
*Assistant Examiner*—Christopher K. Montgomery
*Attorney, Agent, or Firm*—Oliff & Berridge

[57] ABSTRACT

A transducer includes one or more electro-acoustic motors located on a same internal plane or as a peripheral ring of a flexible envelope to which they are interdependent by at least one-of their ends by an assembling device and to which they transmit their vibrations, the flexible envelope being in contact with the liquid and constituting the acoustic waves emitting surface. The flexible envelope is shaped such that the amplitude of the vibrations is increased in a range of very low frequency. The envelope includes at least one orifice allowing the liquid to enter the whole internal cavity delimited by the envelope and a baffle made up of alveolar material that resists the immersion pressure and fills most of the cavity volume. The external surface of the baffle is at a constant distance from that of the interior of the envelope and is interdependent to the assembling device of the acoustic motors. As a result, the transducer produces very low frequency waves when used in liquid at great depths without being complicated in design.

12 Claims, 3 Drawing Sheets

METHOD OF EMITTING VERY LOW FREQUENCY HIGH POWER ACOUSTIC WAVES, AND CORRESPONDING TRANSDUCERS THEREFOR

BACKGROUND OF THE INVENTION

The present invention relates to a method for emitting very low frequency, high power acoustic waves, and providing transducers for producing these waves. The technical field of the invention is the realization of electro-acoustic transducers for emitting acoustic waves immersed in a liquid. The principal application of the invention relates to the possibility of emitting very low frequency and high power acoustic waves, whatever the immersion depth is.

In particular, known for such low frequency underwater acoustic waves, are the submersible electro-acoustic transducers called flextensional transducers; they comprise one or more electro-acoustic motors, generally piezoelectric motors, located according to a same interior plane or as a peripheral ring of an envelope or flexible shell. This shell, when put in contact with water, constitutes the emitting surface of the acoustic waves. These transducers convert the shell oscillations generated in the plane where the electro-acoustic motors are located, and due to the dilation-compression effects, they are converted into oscillations perpendicular to this plane and thus in plane deflection, hence their name: flextensional transducers. They make it possible to amplify the motor oscillation amplitude by a factor of 3 and even 4 and thus to obtain very low frequencies.

It is recalled that the known flextensional transducers, can be grouped in five classes depending on their general shell shape:

Class I groups transducers with a shell in ellipsoid of revolution around an axis and a single electro-acoustic motor, which may be piezoelectric or magnetosostrictive, and is coaxial with the revolution axis of the shell, and which is mechanically and acoustically coupled by both extremities with both portions of the shell surfaces located on the axis of revolution.

Class II groups the transducers with a disk-shaped or revolution ring-shaped shell around the disk or ring axis. These transducers comprise several piezoelectric motors, radially arranged around the revolution axis of the shell and mechanically and acoustically coupled to the revolution axis, either by one of their extremities in the case of a disk shape, with the other extremity resting on a central pillar, or by both extremities in the case of a ring shape;

Class III groups the transducers whose shell has two bulges at both extremities and whose general shape is of the bone or diabolo type;

Class IV groups the transducers whose shell is an elongated cylinder, whose straight cross section is elliptical or is a closed curve with a throttler in its central part. The transducers of this class comprise several electro-acoustic motors parallel to each other and whose axes are located in transverse planes perpendicular to the cylinder generatrix and following the direction of the largest of the section axis: both extremities of each motor are mechanically and acoustically coupled to the cylindrical shell;

Class V groups the transducers whose shell is a combination of the shape of those of Class I and those of Class IV, or those of Class II; and which can be qualified as "oyster" shape: in fact, it is an ellipsoid type shape, possibly of revolution, but flattened and not elongated as in Class I, or a very flattened spheroid, or even a toric generated by a circumference comprising a rectilinear side around which it rotates and which constitutes its axis.

The present invention is related more particularly, but not exclusively, to flextensional transducers of Classes IV and V above.

All the flextensional transducers have many advantages for the emission of low and very low frequency waves, nevertheless they have also disadvantages as they require the shells or envelopes, to be either closed and water-tight, or open and non water-tight,in which case special devices are now used to limit the effects of this non-watertightness.

Indeed, the acoustic waves to be emitted in low frequencies must be provoked by the vibrations of external shells alone, and no other wave induced by internal shell vibrations and electro-acoustic motors must escape from the inside of the latter in order not to interfere with the low frequency emission. Thus, as a first alternative, the shell may be closed and filled with gas, and it must then resist the immersion pressure. However, the use of such transducers in low depths is limited, for if the shell resistance must be increased to withstand great depth pressure, the elasticity is decreased and therefore the possibility of emission increases. To avoid increasing this resistance and to keep this elasticity, specific devices have been developed, some of which are disclosed in various patents.

Indeed, all these devices consist of using the possibility of compensating the external pressure by increasing the internal pressure, and in various ways depending on the inventions, in order to avoid a water-tight box to withstand the efforts of resistance to external pressure. The following may be mentioned:

French patent application FR 2 634 292, called "method and device to maintain the pressure of the gas contained in an immersed chamber the pressure in balance with the external pressure", consists in associating with an immersed chamber, such as the box of a piezoelectric transducer, several bottles which contain a deformable pocket, preinflated at various pressures, and thus making it possible to compensate the hydrostatic pressure at various depths of immersion;

French patent application FR 2 665 814, relating to "electro-acoustic transducers intended for immersion", includes an automatic compensation system of the immersion pressure, thanks to chambers filled with gas and reduced volumes, in order to compensate only the axial loads exerted on the ceramic central pillar of the transducer.

Other patent applications could be mentioned which use pneumatic systems of compensation of the external immersion pressure, but comprising all the mechanical means fairly voluminous gas and/or complicated supply or storage means.

Another known alternative consists in having a non water-tight shell, and filling it with liquid to eliminate the here-above compensation devices:

by using a fluid different from the ambient medium and by installing a separating membrane which also acts as a flexible diaphragm compensating the differences of internal volume due to the compressibility of the internal fluid, generally oil. This is disclosed in French patent application FR 2 671 927, relating to "directive electroacoustic transducers and manufacturing methods and devices"; but in the present application to very low frequency transducers of the flextensional type, it is then impossible to eliminate the waves induced by the internal vibrations, which is not the aim sought after; or by using the liquid of the ambient medium. The present invention belongs to this last category, in which, presently, in order to solve both the problem of behaviour in immersion, and that of the internal waves, communication orifices are made in the transducer shell, having dimensions so that the fundamental vibration frequency of the whole is to be close to the Helmholtz frequency of the cavity and, moreover, depending on the case, various devices are added in these orifices and/or the cavity formed by the shell to adjust both frequencies and obtain the required effect.

However, even in this case, the emission is disturbed, especially in the range of very low frequencies, and moreover, contrary to the objectives of the present invention, the emission level is lowered, thus limiting the possibility of emitting at high power.

SUMMARY OF THE INVENTION

The present invention relates to the capability of emitting very low frequency acoustic waves in a liquid, without being disturbed by the depth, without complicating the design of the transducer realization which, for these ranges of frequency, are of the flextensional type, all in allowing high power emissions.

This objective is reached by a process of emitting such very low frequency acoustic waves in a liquid, using a known type of transducer comprising one or more electro-acoustic motors located on the same internal plane or as a peripheral ring of a flexible envelope, interdependent to the envelope at least at one of their extremities by any assembly device, to which they transmit their vibrations so that the envelope in contact with the liquid constitutes the emitting surface of the acoustic wave, and whose shape is such that the amplitude of these vibrations is amplified, and that the waves are of low frequency; according to the method of the invention:

- the liquid is allowed to enter the entire inside cavity delimited by this envelope by means of any orifice communicating with the outside;
- a baffle, preferably made up of alveolar material resistant to the immersion pressure, is placed in the cavity; it occupies most of the cavity volume and its external surface is at a constant distance from that of the envelope;
- the baffle is interdependent to the assembly device of the acoustic motors;
- the motors are requested to emit the very low frequency and high power acoustic waves.

An objective of the present invention is also reached with a transducer of the same known type as the previously one mentioned, and in which the chamber, made up of part of the envelope, comprises at least any orifice allowing the liquid to enter the entire inside cavity delimited by the chamber and a baffle made up of alveolar material resisting to the immersion pressure filling most of the cavity volume, whose external surface is at a constant distance from that of the vibrating envelope, and which is interdependent to the assembly device of the electro-acoustic motors. In a preferred embodiment, the alveolar material has an acoustic impedance lower than 0.7 times that of the water, e.g. a P.V.C.-based (polyvinyl chloride) material of the cellular plastic type, and with closed porosities.

In an application to Class V transducers previously mentioned, in which the envelope shape and type are ellipsoid, the envelope comprises two convex disks placed opposite each other, and connected by at least one ring-shaped part at their periphery, so that both disks are just supported and fixed at their periphery, each one in a groove of the said toric piece.

It results in a new method of emission of very low frequency high power acoustic waves, as well as corresponding new transducers, making such emission possible. Indeed, these methods and transducers whose characteristics have been previously indicated, reduce the various disadvantages previously mentioned in the flextensional transducers existing today, solve the problem and meet the fixed objectives; the chamber orifice making possible the communication between the internal cavity and the external liquid, this allows for having a system in continuous equipressure, requiring no system of compensation. It is important to note that the maximum depth of the transducer immersion according to the invention is limited only to the resistance to the pressure of this material.

The presence of this alveolar material filling the inside of the cavity, absorbs the effect, of a rear radiation of the shell on the one hand, and of the vibrations of the electro-acoustic motors themselves on the other hand which could radiate inside the cavity, as it is used in other types of transducers; however, in the present invention, the additional presence of a water film between the baffle mass and the vibrating shell, increases the inertia of the shell, thus allowing for the emission of still lower frequencies, of the order of at least 30% compared to a system filled with air. Moreover, the combination of various characteristics previously indicated, makes it possible to keep a nearly constant level of emission power compared to the known systems filled with air, and whose disadvantages have been previously mentioned, and this is not the case of the other known, transducers in equipressure. In other respects, the total immersion of all the transducer pieces and particularly the cavity, allows for a better cooling of the electro-acoustic motors by calorific diffusion facilitated by the presence of the external flow which is water, where as in in the systems filled with air, this cooling is of course more difficult.

These advantages are of course also found in the immersed systems existing otherwise they use devices making it possible to play on the proper frequencies, but as previously indicated, they decrease the power of emission as the pass band is widened, and this is not the objective reached in the present invention.

For Class V flextensional transducers as previously mentioned, and for which, in a particular embodiment, the two half-shells are immobilized in a peripheral toric support, in which the two half-shells are neither welded or rigidly fixed, a greater flexion effect is obtained at the level of the peripheral edge base, thus allowing for a larger displacement of the shells for the same ceramics displacement, allowing for an increase of the emission level and an even lower frequency.

Other advantages of the present invention could be mentioned, but the ones previously mentioned demonstrate its novelty and interest.

BRIEF DESCRIPTION OF THE DRAWINGS

The description and one of the hereafter figures shows an example of the embodiment of the invention, but they are not limiting; other embodiments are possible within the framework of the range and extent of the invention, particularly, by changing the basic shape of the flexible shell and the arrangement of the electroacoustic motors, as in the various classes previously indicated.

DETAILED DESCRIPTION OF PREFERRED EMBODIMENTS

Figure 1:
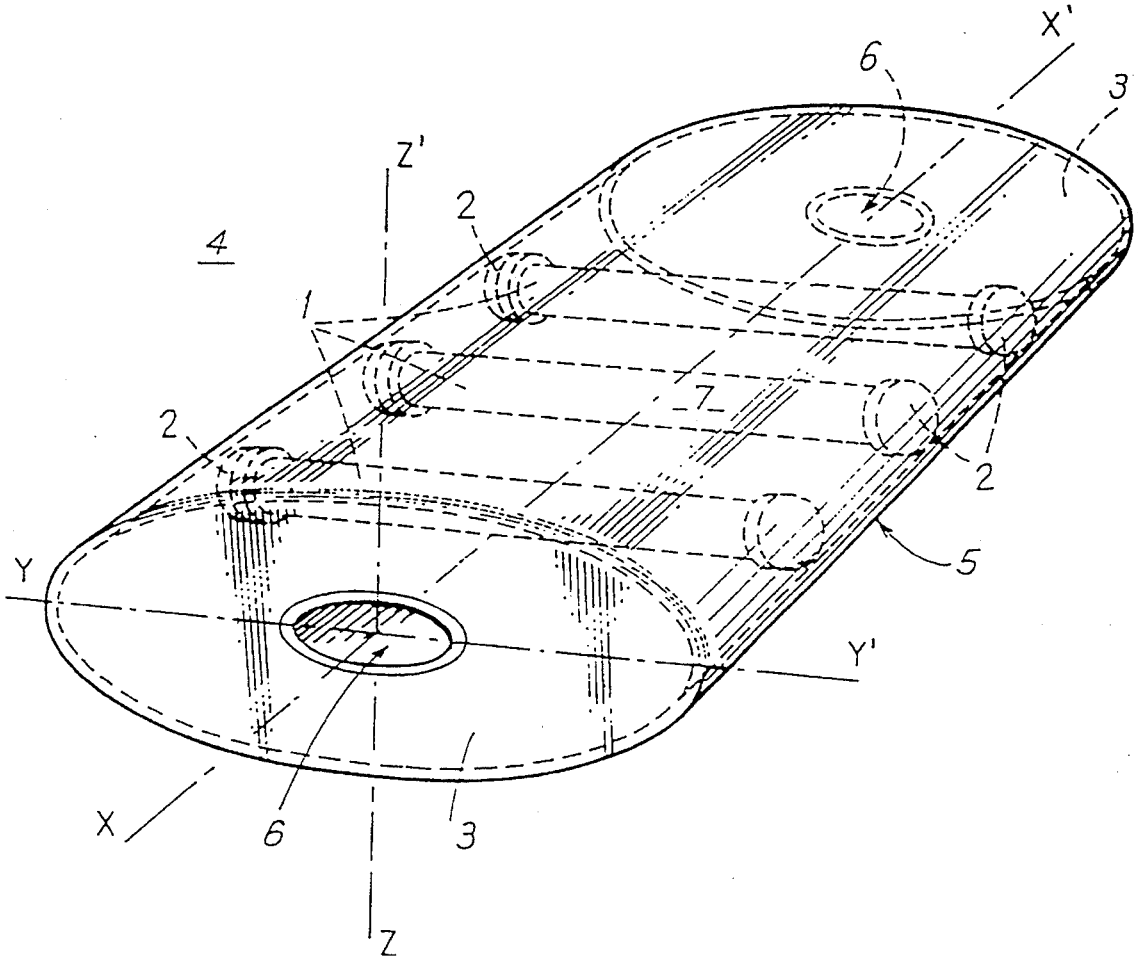
PRIOR ART FIG. 1
FIG. 1 is a perspective view of a conventional Class IV flextensional transducer.
Figure 2:
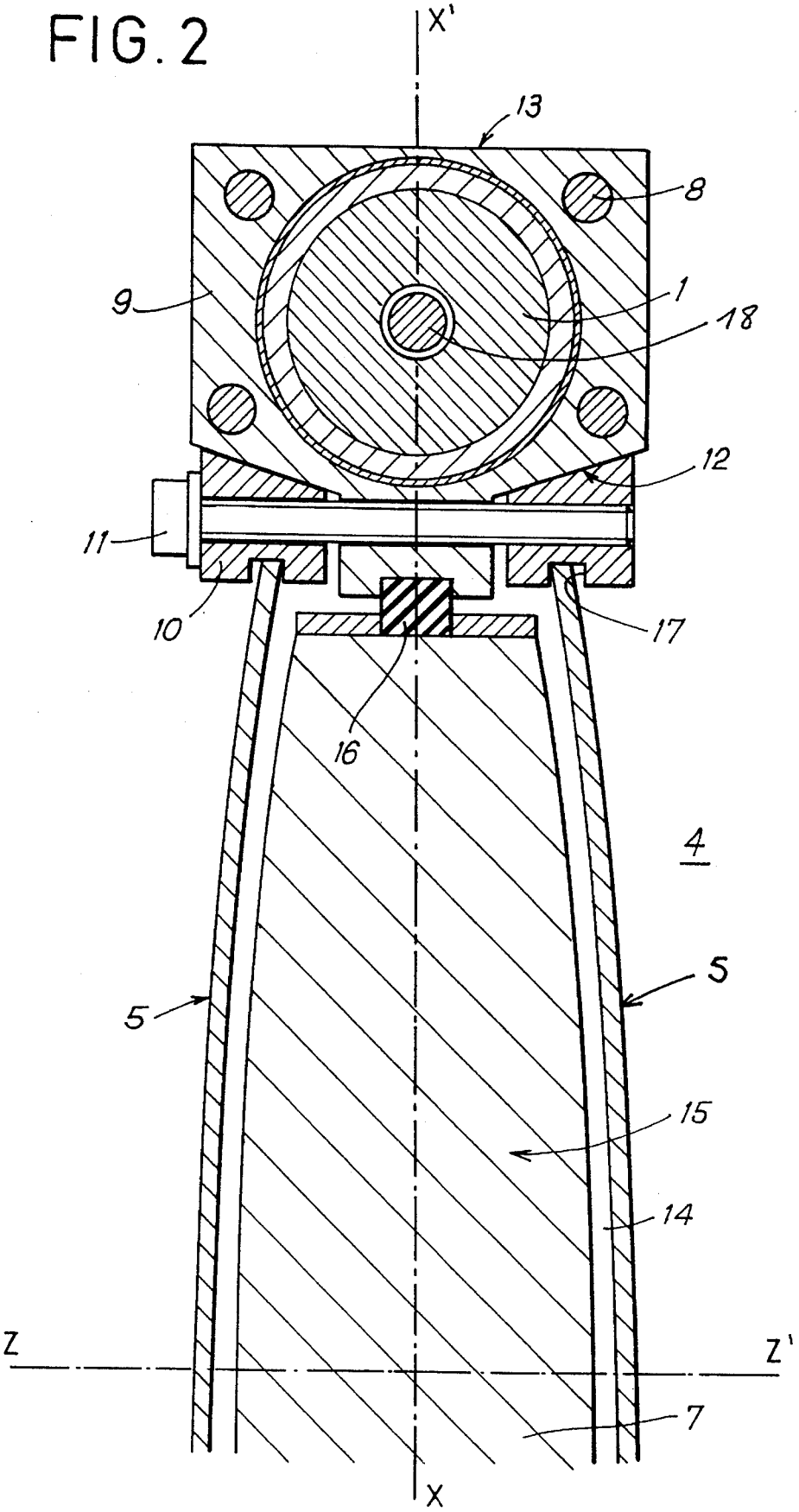
FIG. 2 is a cutaway view of a Class V flextensional transducer embodied according to the present invention.
Figure 3:
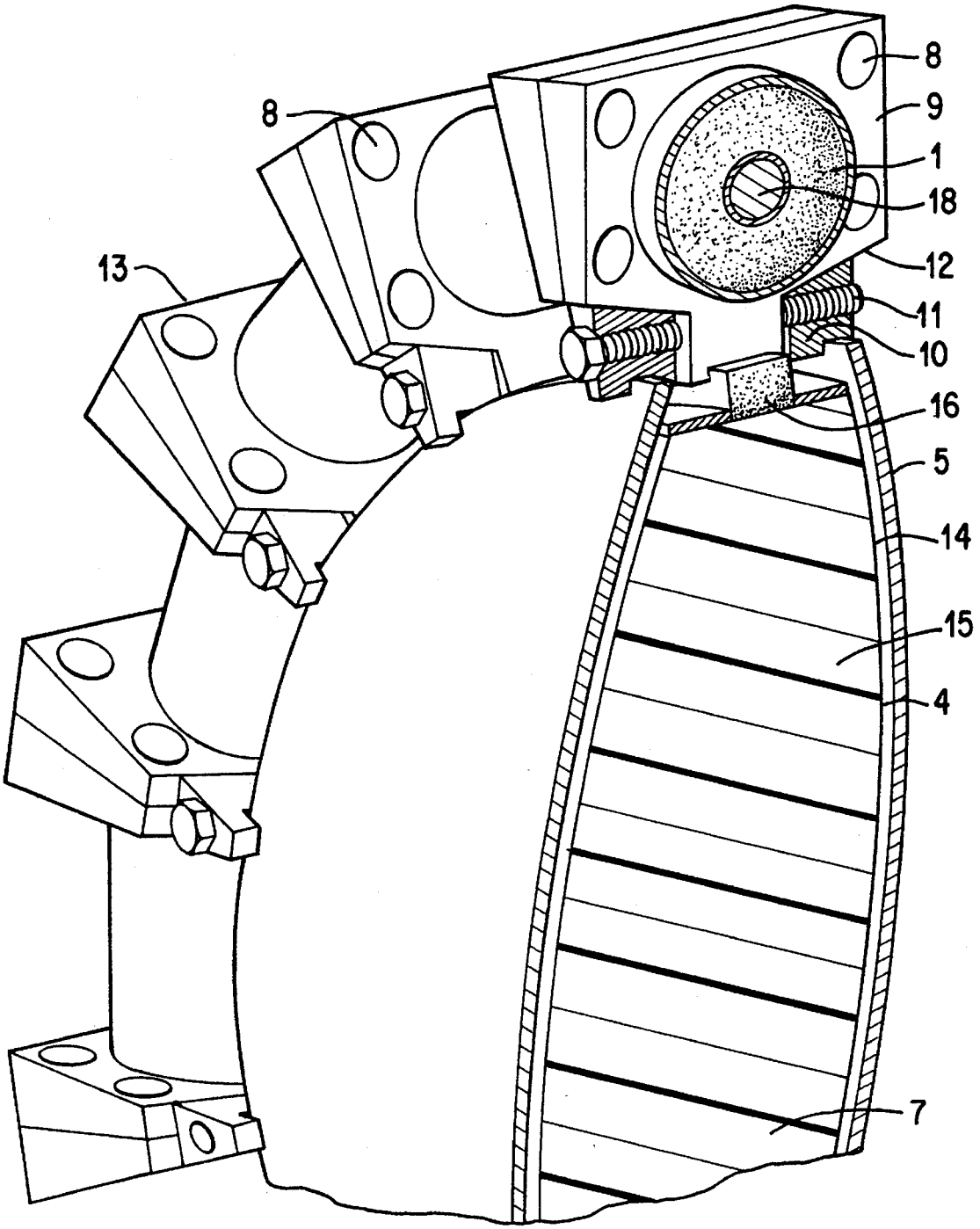
FIG. 3 is a partial perspective view of a class V flextensional transducer according to the present invention.

In these figures, the transducers represented are only examples, for FIG. 1 of a type IV transducer, and for FIGS. 2 and 3 of a type V transducer: as it is known, they comprise one or more electro-acoustic motors 1, placed according to a same plane defined by axis xx'/yy', inside in FIG. 1 and as a peripheral ring in FIG. 2 of a flexible envelope 5, with which they are; interdependent, at least at one of their extremities by any assembling device: i.e in FIG. 1 for the pieces or linking masses 2, and in FIG. 2 for the peripheral pieces 10 of fixation and connection with countermasses 9 and electro-acoustic motors 1 connected by machine screws 8; the electro-acoustic motors 1 and their countermasses 9 transmit their vibrations to the flexible envelope 5 which is in contact with the external liquid 4, making up the acoustic wave emitting surface; the flattened ellipsoid shape of the surface makes it possible to amplify the vibration amplitude and obtain a very low frequency wave range:

In FIG. 1, the type IV transducer represented, has an elongated cylindrical-shaped flexible envelope 5, whose section in straight cut is elliptical, and the electro-acoustic motors 1, three in this example, are parallel, according to an axis yy' and their axes are located in transverse planes perpendicular to the cylinder generatrix according to axis xx' of envelope 5.

In FIG. 1, both extremities of each motor are mechanically and acoustically coupled by connecting parts 2 with cylindrical shell 5, but in other cases, particularly with Class II transducers depending on the shape of the shell, the motors 1 may be interdependent only at one of their extremities, the other one possibly resting on a central pillar acting as a countermass.

The cylindrical envelope 5 extremities are closed by plates 3 which do not directly contribute to the amplification of shell 5 vibrations caused by the vibrations of electro-acoustic motors 1; to allow for the liquid equipressure and penetration inside cavity 7, one of the end plates 3 comprises at least one orifice 6, whose size according to the existing systems, associated to the characteristics of envelope 5, are determined in such a way that by coupling the elasticity of this envelope with the mass of liquid 4 located in the orifice 6, the Helmoltz frequency of cavity 7 is close to the fundamental frequency of the vibrations of the whole made up of the electro-acoustic motors 1 and to any element associated to the electro-acoustic motors 1, such as connection parts 2.

Taking into account the disadvantages previously mentioned in this embodiment, such a type IV transducer according to FIG. 1 could be equipped, according to the present invention, with an internal baffle 15, as shown in the example of FIGS. 2 and 3, and connected to the central part of electro-acoustic motors 1, since such a baffle must not be driven by external envelope 5 and may vibrate with it.

In the cutaway view of FIG. 2 according to plane xx'/zz', radial to the concerned type V transducer, the transducer comprises a motor ring made up of a collar of several ceramic pillars or electro-acoustic motors 1, (e.g. eight), and associated coutermasses 9, connected by various machine screws 8 making possible the continuity of driving peripheral collar 13. Moreover, central rods 18 ensure the prestressing of ceramic pillars 1.

The description of the ring motor element is not further defined within the framework of the present description, as this is not within the scope of the invention, and there are already various transducer systems using such an arrangement.

According to FIGS. 2 and 3, envelope 5 forming the vibrating shell comprises two convex disks linked at their periphery by at least one ring-shaped part 10, so that these two convex disks 5 are only supported and immobilized at their periphery each one in a groove 17 of part 10. Both convex disks may be rotated towards the outside, but also and eventually towards the inside or one towards the outside and the other towards the inside, but preferably the orientation of the convexity of both disks towards the outside as represented in the figure, will be chosen.

Each groove 17 is supported by elements arranged in a ring, and constituting pieces 10, independent of each other for each of the two opposite and convex disks, and linked two by two, on both sides of the plan in which acoustic motors 1 are located, by a device 11 that allows adjusting the relative distance between the pieces 10; each piece 10 comprises a conical surface 12, cooperating with a surface having the same shape, born by another continuous external peripheral ring 13, in order that the moving together of the elements of piece 10 by means 11, reduces the length of grooves 17 circumference by means of a clipping effect and ensures disks 5 prestressing.

This technical choice of a solution to prestress each part of the shell makes it possible to eliminate the locating points which would be complicated and expensive, as well as any equipment which would bring manufacturing difficulties. Moreover, an easy dismantling of the bulged shells and better transducer maintenance is made possible.

The chamber comprising the thus constituted envelope 5, contains any orifice (not shown) allowing the liquid 4 to enter the entire internal cavity 7 delimited by the envelope, e.g. an orifice between two motors 1 in the external ring 13.

A baffle 15 preferably made up of alveolar material resistant to the immersion pressure, fills the greater part of the cavity volume, whose external surface is at a constant distance 14 from that of envelope 5, and which is interdependent to the assembling device 8 of electro-acoustic motors 1 in ring 13. This assembly may be realized by elastic studs 16 spaced on the rear structure of transducers, such as the one constituted by the supports and countermasses 9 on all the periphery of that external ring 13.

Preferably, the elastic characteristics of the material making up studs 16 make the radial displacement speed in compression lower than ten times that of the electro-acoustic motors.

To obtain an additional inertia effect, while making it possible to absorb the rear wave emissions, the distance 14 separating the surfaces of baffle 15 of envelope 5 and filled with liquid 4 is between 3 and 6 mm.

For the baffle to make it possible to obtain the requested maximum effect, the acoustic and specific impedance, also called the characteristic impedance of the material which makes it up, and which is defined by the product of it volumic mass rm and its wave propagation speed Cm in the material, must be such as: (rm×Cm) of the material <0.7 of (ro×Co) of water.

This is preferably obtained, for example, with a P.V.C.- based (polyvinyl chloride) cellular plastic having a closed porosity, which moreover, makes it possible for some foam qualities to withstand depths up to 1,000 meters.

We claim:

1. A method of emitting very low frequency acoustic waves in a liquid using at least one transducer, said transducer having at least one electro-acoustic motor and a flexible envelope that is an emitting surface for said acoustic waves, said at least one electro-acoustic motor being coupled to an assembling device and said assembling device being coupled to said flexible envelope such that each said at least one electro-acoustic motor is disposed in a peripheral ring around said flexible envelope, said flexible envelope having an internal cavity with an orifice through which said liquid enters, said flexible envelope having a shape that generally conforms to a shape of said internal cavity and being a constant distance from a baffle disposed within said internal cavity, said baffle being coupled to said at least one electro-acoustic motor, wherein said method comprises the steps of:

flowing said liquid into said internal cavity via said orifice such that said liquid contacts said baffle; and producing said low frequency waves in said liquid by operating said at least one electro-acoustic motor, thereby causing said flexible envelope to vibrate.

2. A transducer that produces very low frequency acoustic waves in a liquid, comprising:

a flexible envelope that is an emitting surface for said acoustic waves, said flexible envelope having an internal cavity with an orifice through which said liquid enters;

at least one electro-acoustic motor disposed on a same plane in a peripheral ring around said flexible envelope;

a baffle disposed at a constant distance from said flexible envelope., Skid baffle having a shape that generally conforms to a shape of said internal cavity; and an assembling device to which said baffle and each said at least one electro-acoustic motor are coupled, wherein operating said at least one electro-acoustic motor produces vibrations that are emitted as said low frequency waves in said liquid.

3. The transducer of claim 2, wherein a volume occupied by said baffle is at least as great as about one-half a volume defined by an interior surface of said flexible envelope.

4. The transducer of claim 2, wherein said baffle is made from alveolar material.

5. The transducer of claim 4, wherein said alveolar material is a polyvinyl chloride-based cellular plastic having closed porosities.

6. The transducer of claim 4, wherein said alveolar material has an acoustic impedance 0.7 times lower than an acoustic impedance of said liquid.

7. The transducer of claim 2, wherein a distance separating said baffle from said flexible envelope is approximately 3 mm to approximately 6 mm.

8. The transducer of claim 2, further comprising elastic studs fabricated from an elastic material, wherein said baffle is connected to said assembling device by said elastic studs.

9. The transducer of claim 8, wherein an elasticity of said elastic material causes said elastic studs to have a displacement radial speed in compression that is about ten times lower than a displacement radial speed in compression of said electro-acoustic motors.

10. The transducer of claim 2, wherein said flexible envelope includes two convex disks disposed opposite each other and said assembling device is at least one ring-shaped piece, and wherein said convex disks are disposed in respective grooves of said assembling device such that said flexible envelope defines an ellipsoid shape.

11. The transducer of claim 10, wherein each said at least one ring-shaped piece includes two ring components connected by an adjusting device, each of said two ring components having a groove for receiving one of said two convex disks, wherein a distance between said two convex disks is adjusted by operating said adjustment device to move said two ring components relative to each other.

12. The transducer of claim 11, wherein said two convex disks are prestressed by decreasing the distance between them through the operation of said adjustment device.

* * * * *